US011286617B2

(12) United States Patent
Gronych et al.

(10) Patent No.: US 11,286,617 B2
(45) Date of Patent: Mar. 29, 2022

(54) MACHINE FOR DEWATERING AND DRYING A FIBROUS WEB

(71) Applicant: Voith Patent GmbH, Heidenheim (DE)

(72) Inventors: Daniel Gronych, Heidenheim (DE); Thomas Rühl, Wernau (DE)

(73) Assignee: Voith Patent GmbH, Heidenheim (DE)

( * ) Notice: Subject to any disclaimer, the term of this patent is extended or adjusted under 35 U.S.C. 154(b) by 196 days.

(21) Appl. No.: 16/207,902

(22) Filed: Dec. 3, 2018

(65) Prior Publication Data

US 2019/0100876 A1 Apr. 4, 2019

Related U.S. Application Data

(63) Continuation of application No. PCT/EP2017/062865, filed on May 29, 2017.

(30) Foreign Application Priority Data

Jun. 3, 2016 (DE) ..... 10 2016 209 780.6

(51) Int. Cl.
*D21F 3/04* (2006.01)
*D21F 5/04* (2006.01)
(Continued)

(52) U.S. Cl.
CPC ..... *D21F 3/045* (2013.01); *D21F 1/32* (2013.01); *D21F 1/76* (2013.01); *D21F 5/042* (2013.01); *D21F 7/04* (2013.01)

(58) Field of Classification Search
CPC ... D21F 2/00; D21F 3/04; D21F 3/045; D21F 3/0209; D21F 5/04; D21F 5/042; D21F 7/04
(Continued)

(56) References Cited

U.S. PATENT DOCUMENTS 4,483,745 A * 11/1984 Wicks ..... D21F 2/00 162/205
5,431,787 A * 7/1995 Braun ..... D21F 3/04 162/358.3
(Continued)

FOREIGN PATENT DOCUMENTS

DE 101 34 233 A1 1/2003
DE 10 2005 001 890 A1 7/2006
WO WO 2006/090014 * 8/2006 ..... D21F 1/32

OTHER PUBLICATIONS

Notice of Transmission of the International Research Report and the Written Notice Issued the International Searching Authority or Declaration dated Jul. 28, 2017 for International Application No. PCT/EP2017/062865 (12 pages).

*Primary Examiner* — Eric Hug
(74) *Attorney, Agent, or Firm* — Taylor IP, P.C.

(57) ABSTRACT

A machine for dewatering and drying a paper, cardboard or other fibrous web, to which machine a fibrous stock suspension is fed which is formed at least partially from waste paper. The machine includes at least two press nips which are formed in each case by two press rolls, wherein a fibrous web runs through first press nip with a water absorbing dewatering belt on both sides. The fibrous web then runs through a second press nip with at least one other dewatering belt and a smooth impermeable transfer belt on both sides. A transfer belt transfers the fibrous web after second press nip to a belt in a downstream machine unit, e.g. dryer group. The dryer group allows the fibrous web to be guided in a serpentine manner alternatively over heated dryer cylinders and vacuum equipped guide rolls.

11 Claims, 1 Drawing Sheet

(51) Int. Cl.
*D21F 1/32* (2006.01)
*D21F 7/04* (2006.01)
*D21F 1/76* (2006.01)

(58) Field of Classification Search
USPC ..... 162/191, 255, 264
See application file for complete search history.

(56) References Cited

U.S. PATENT DOCUMENTS

| | | | | |
|---|---|---|---|---|
| 6,214,168 | B1 * | 4/2001 | Puustinen | C04B 26/10 162/193 |
| 6,368,466 | B1 * | 4/2002 | Laapotti | D21F 3/04 162/358.3 |
| 6,432,273 | B1 * | 8/2002 | Honkalampi | D21F 2/00 162/205 |
| 2012/0055644 | A1 * | 3/2012 | Mausser | D21F 3/0227 162/210 |

* cited by examiner

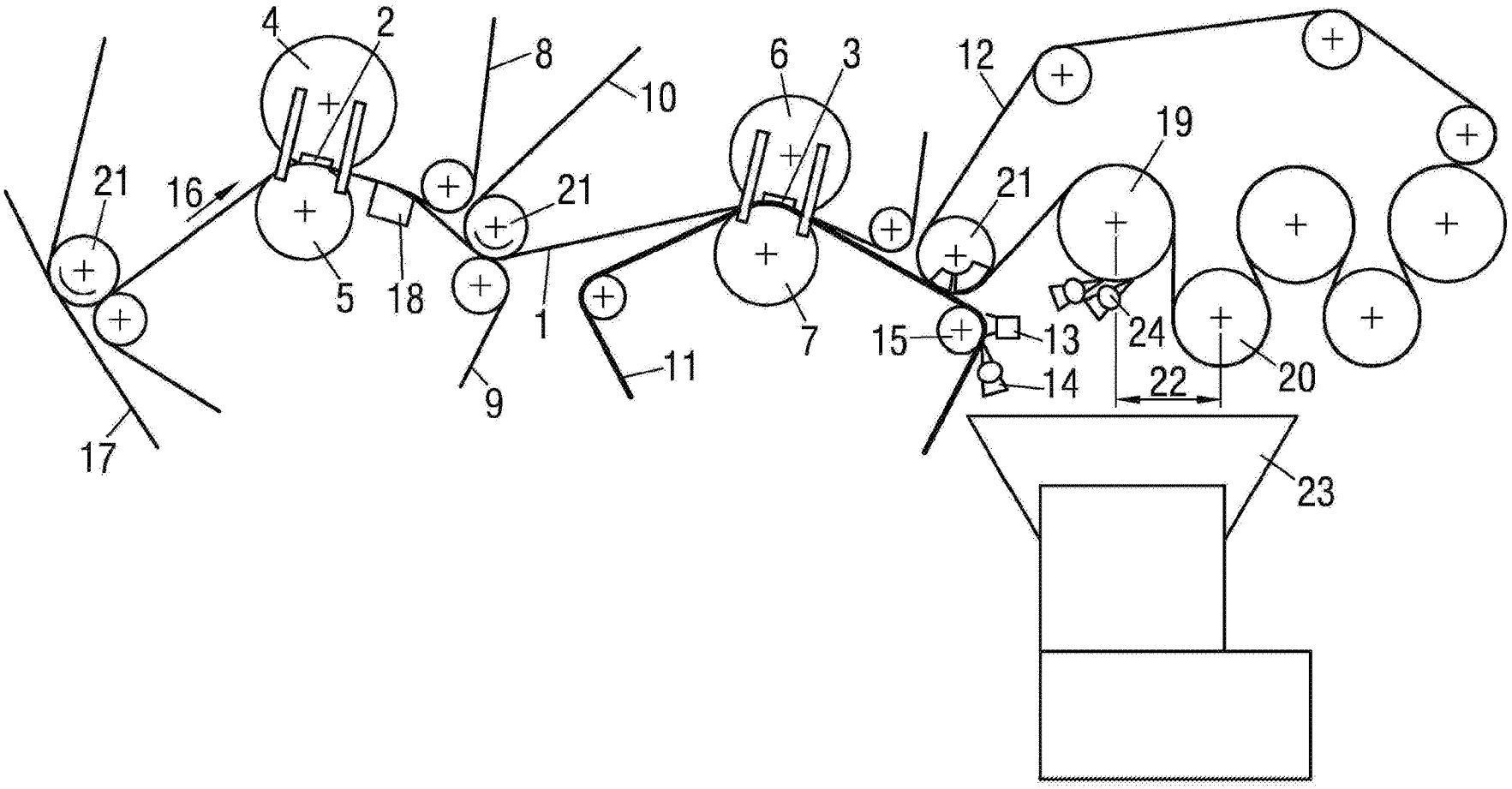
1
2
3
4
5
6
7
8
9
10
11
12
13
14
15
16
17
18
19
20
21
22
23
24

MACHINE FOR DEWATERING AND DRYING A FIBROUS WEB

CROSS REFERENCE TO RELATED APPLICATIONS

This is a continuation of PCT application No. PCT/EP2017/062865, entitled "MACHINE FOR DEWATERING AND DRYING A FIBROUS WEB", filed May 29, 2017, which is incorporated herein by reference.

BACKGROUND OF THE INVENTION

1. Field of the Invention

The present invention relates to a machine for dewatering and drying a paper, cardboard or other fibrous web.

2. Description of the Related Art

Machines for dewatering and drying a paper, cardboard or other fibrous web are known. Fibrous stock suspensions produced from waste paper on known machines include an increased portion of contaminants. Accordingly, the fibrous webs produced therefrom lead to greater contamination of elements coming in contact with said webs, in particular if these elements have a relatively high adhesion, in particular a smooth surface. For this reason, the two press nips often have two separate dewatering belts, so that the fibrous web can be guided securely between them. However, this is then also associated with a high rate of rewetting of the fibrous web after the press nip.

To reduce this rewetting, it is also known to run only one, usually an upper dewatering belt through the second press nip. The fibrous web then adheres after the second press nip to the smooth roll surface of the respective press roll and is then transferred in an open section to a belt of a downstream dryer section. The delivery of the fibrous web with an open section is herein difficult, especially at high machine speeds, and a complex transfer.

What is needed in the art is a machine to simplify the transfer of the fibrous web.

SUMMARY OF THE INVENTION

The present invention provides a machine for dewatering and drying a paper, cardboard or other fibrous web having a transfer belt running under the fibrous web, a receiving belt made up of a dryer fabric and a downstream machine unit that is a dryer group in which the fibrous web is guided in a serpentine manner alternatively over heated dryer cylinders and vacuum equipped guide rolls. At least one removal receiving doctor is assigned to the first dryer cylinder of the downstream dryer group and includes a pulper located under the removal doctor. The axis of the dryer cylinder with the removal doctor and the axis of the following vacuum equipped guide roll are offset vertically relative to one another and are located at a horizontal distance from one another that is greater than 80% of the sum of the radii of the dryer cylinder and the guide roll.

As the fibrous web is continuously guided in the press section by at least one belt, web travel is very stable, even at high machine speeds. Moreover, web-wide transfer through the press section can thus occur at least up to the first dryer cylinder of the downstream dryer group, rendering this also very reliable. A transfer only to the end of the press section is problematic, since removal of the fibrous web from the transfer belt by a removal doctor can easily lead to damage of the transfer belt, because of the necessary contact pressure.

The horizontal distance between the axes creates enough space for the pulper in order to move the fibrous web during the transfer, stably and reliably from the removal doctor into the pulper that is located below same. This also reduces the risk that the fibrous web during the transfer is not guided into the pulper but is further conveyed on the dryer cylinder or the dryer fabric, thereby causing damage to the machine elements.

In one exemplary embodiment, the axis of the dryer cylinder with the removal doctor and the axis of the following suction equipped guide roll have a horizontal distance from one another that is greater than 90% and in particular greater than 95% of the sum of the radii of said dryer cylinder and said guide roll.

After the second press nip, the fibrous web adheres to the smooth transfer belt, so that the opposite relatively rough dewatering belt can be redirected away immediately, at most 200 mm after the press nip, thus preventing rewetting.

The transfer belt subsequently guides the web securely to the belt of the downstream machine unit. Subsequently the transfer belt is cleaned by a cleaning device which directs a cleaning fluid at a pressure of at least 50 bar onto the side carrying the fibrous web and which includes at least one doctor.

In another exemplary embodiment, the cleaning device directs the cleaning fluid at a pressure of even at least 100 bar, preferably at least 120 bar onto the side of the transfer belt carrying the fibrous web. Because of the high pressure and in order to ensure sufficient contact with the doctor, the transfer belt should be supported on at least one guide roll in the region of the cleaning device.

At least one or preferably both press nips should be extended during an intensive and volume-protective dewatering. The extended press nip is formed by a cylindrical press roll and a shoe press roll that is equipped with a flexible roll cover that is pressed by a pressure shoe having a concave contact surface against the cylindrical roll. The extended press nip may extend over at least 250 mm in machine direction and/or have a linear force of at least 800 kN/m.

For reliable support of the fibrous web, the transport belt should proceed beneath the fibrous web. This produces sufficient adherence of the fibrous web on the transfer belt if said belt on the side supporting the fibrous web has a roughness Rz in machine direction of less than 12 μm, preferably less than 10 μm and in particular less than 8 μm.

Moreover, the distance between the second press nip and the transfer of the fibrous web to the receiving belt should be shorter than 2.5 m, preferably shorter than 2 m and in particular shorter than 1.5 m.

To guide the fibrous web reliably even before the press nips, the fibrous web is carried prior to the first, preferably prior to each press nip by both belts of the respective press nip over as long as possible travel section.

After the first press nip, the fibrous web adheres with approximately the same intensity on both dewatering belts; therefore, the upper dewatering belt of the first press nip should be redirected away from the fibrous web during suction application upon the lower dewatering belt.

In one embodiment, the machine is configured for the production of a fibrous web having a base weight between 50 and 180, preferably between 50 and 120 g/m2.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawing, wherein:

The sole FIGURE illustrates an embodiment of a machine for dewatering and drying a fibrous web formed according to the invention.

Corresponding reference characters indicate corresponding parts throughout the several views. The exemplifications set out herein illustrate embodiment of the invention and such exemplifications are not to be construed as limiting the scope of the invention in any manner.

DETAILED DESCRIPTION OF THE INVENTION

Referring now to the FIGURE, there is shown a machine for dewatering and drying a fibrous web which generally includes two press nips 2, 3 that are formed by respectively two pressed together press rolls 4, 5, 6, 7. The separate press roll pairs are supported at their ends by support components in the embodiment of substructures that are supported on the machine foundation To provide gentle dewatering, both press nips 2, 3 are extended. For this purpose, press nips 2, 3 respectively are formed by a cylindrical press roll 5, 7 and a shoe press roll 4, 6. Shoe press rolls 4, 6 are equipped with a flexible roll cover that is pressed by a pressure shoe having a concave contact surface against cylindrical press roll 5, 7. In a machine direction 16, a press nip length 2, 3 may be at least 250 mm and have a linear force of at least 800 kN/m.

Fibrous web 1 runs through first press nip 2 with one dewatering belt 8, 9 on each side. In contrast thereto, fibrous web 1 is guided by one top dewatering belt 10 and one bottom, smooth and impermeable transfer belt 11 through second press nip 3. Dewatering belts 8, 9, 10 are in the embodiment of water-absorbing press felts.

Top dewatering belt 8 of first press nip 2 accepts fibrous web 1 from a forming fabric 17 of an upstream former for sheet formation. Subsequently, bottom dewatering belt 9 is also brought into contact with fibrous web 1, so that fibrous web 1 is led over as long as possible a distance prior to press nip 2 by both belts 8, 9 of press nip 2.

After first press nip 2, fibrous web 1 travels together with both dewatering belts 8, 9 before the top dewatering belt 8 is directed away. To ensure reliable guidance of fibrous web 1 during the redirection of the top dewatering belt 8, suction is applied to bottom dewatering belt 9 in this region by a suction box 18 located under it. Fibrous web 1 is then transferred from the individual guiding bottom dewatering belt 9 to the other, top dewatering belt 10 of second press nip 3.

After second press nip 3 the second top dewatering belt 10 is redirected away from fibrous web 1 after a maximum of 200 mm which minimizes the risk of rewetting, in particular in the case of low base weights.

Bottom transfer belt 11 alone carries fibrous web 1 for transfer to a belt 12, in this case a dryer fabric of a downstream dryer group with only three dryer cylinders 19 of a dryer group for drying fibrous web 1.

In the dryer group, fibrous web 1 is guided in a serpentine manner alternatively over heated dryer cylinders 19 and vacuum equipped guide rolls 20.

Removal doctors 24 are assigned to first dryer cylinder 19 of the downstream dryer group. The doctor removes fibrous web 1 during the transfer from the dryer cylinder 19 then guiding it into a pulper 23 that is located below it.

In order to ensure reliable and stable operation in this regard during the web-wide transfer of fibrous web 1, the axis of first dryer cylinder 19 with removal doctor 24 and the axis of following suction-equipped guide roll 20 are vertically offset relative to one another. These axes moreover, have a horizontal distance 22 from one another that is greater than 95% of the sum of the radii of this dryer cylinder 19 and this guide roll 20.

During takeover of fibrous web 1, top dewatering belts 8, 10 and the dryer fabric respectively wrap around a suction-equipped guide roll 21.

In the interest of a reliable web travel, especially at base weights between 50 and 120 g/m2 and/or machine speeds of higher then 1.00 m/min, the distance between second press nip 3 and the delivery of fibrous web 1 to the acquiring dryer fabric is shorter than 1.5 m. A relatively smooth surface of transfer belt 11 with a roughness Rz in machine direction 16 of less than 10 μm ensures sufficient adherence of fibrous web 1 on transfer belt 11 on the side carrying the fibrous web.

Because of the high content of contaminants, a relatively high contamination of transfer belt 11 is to be expected due to the contact of fibrous web 1 with same.

In order to render a long and reliable operation possible, transfer belt 11 is intensively cleaned by a cleaning device 13 after delivery of fibrous web 1.

This cleaning device 13 directs a cleaning fluid at a pressure of at least 100 bar onto the side of transfer belt 11 carrying the fibrous web. Then, the loosened contaminants are removed from transfer belt 11 by a following doctor.

Because of the high pressure transfer belt 11 is supported on at least one guide roll 15 in the region of cleaning device 13 and doctor 14.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A machine for dewatering and drying a fibrous web formed at least partially from waste paper, the machine comprising:

a press section including a plurality of press rolls forming at least two press nips therebetween, the at least two press nips including a first press nip and a second press nip;

the first press nip being configured to allow two water absorbing dewatering belts and the fibrous web contained therebetween to run through;

the second press nip being configured to allow at least one other dewatering belt and a smooth impermeable transfer belt with the fibrous web contained therebetween to run through, the smooth impermeable transfer belt running under and transferring the fibrous web after the second press nip to a receiving belt in a downstream machine unit, the receiving belt being a dryer fabric and the downstream machine unit being a dryer group in which the fibrous web is guided in a serpentine manner alternatively over at least one heated dryer cylinder and at least one vacuum equipped guide roll, the at least one heated dryer cylinder including a first heated dryer cylinder and a second heated dryer cylinder downstream of the first heated dryer cylinder;

at least one removal receiving doctor being assigned to the first heated dryer cylinder of the downstream dryer group; and a pulper located under the removal receiving doctor, wherein an axis of the first heated dryer cylinder and an axis of the at least one vacuum equipped guide roll are offset vertically relative to one another and located at a horizontal distance from one another, the horizontal distance being 85-95% of the sum of a radius of the first heated dryer cylinder and a radius of the at least one vacuum equipped guide roll such that web travel is stable and a web-wide transfer of the fibrous web through the press section occurs at the first heated dryer cylinder of the downstream dryer group, two of the plurality of press rolls forming at least one of the two press nips are a cylindrical press roll that are extended and a shoe press roll equipped with a flexible roll cover that is pressed by a pressure shoe having a concave contact surface against the cylindrical press roll, the shoe press roll being above the cylindrical roll.

2. The machine according to claim 1, wherein the horizontal distance is greater than 90% of the sum of the radii of the first heated dryer cylinder and the at least one vacuum equipped guide roll.

3. The machine according to claim 1, wherein the smooth impermeable transfer belt after the second press nip and delivery of the fibrous web is cleaned by a cleaning device which directs a cleaning fluid at a pressure of at least 50 bar onto a side of the smooth impermeable transfer belt that carries the fibrous web, the cleaning device further includes at least one doctor.

4. The machine according to claim 3, wherein the smooth impermeable transfer belt is supported on at least one guide roll in a region of the cleaning device.

5. The machine according to claim 1, wherein a distance between the second press nip and a transfer of the fibrous web to the receiving belt is shorter than 2.5 m.

6. The machine according to claim 1, wherein the at least one press nip at least one of extends over 250 mm in a machine direction and has a linear force of at least 800 kN/m.

7. The machine according to claim 1, wherein the smooth impermeable transfer belt on a side supporting the fibrous web has a roughness Rz of less than 12 μm in a machine direction.

8. The machine according to claim 1, wherein the fibrous web is carried prior to the first press nip by the two water absorbing dewatering belts over an as long as possible travel section.

9. The machine according to claim 1, wherein the two water absorbing dewatering belts include an upper dewatering belt and a lower dewatering belt, the upper dewatering belt of the first press nip is redirected away from the fibrous web during a suction application upon the lower dewatering belt.

10. The machine according to claim 1, wherein the at least one other dewatering belt is redirected away from the fibrous web a maximum of 200 mm after the second press nip.

11. The machine according to claim 1, wherein the fibrous web produced on the machine has a base weight between 50 and 180 g/m2.

* * * * *